US009675194B2

(12) United States Patent
Grosjean

(10) Patent No.: US 9,675,194 B2
(45) Date of Patent: Jun. 13, 2017

(54) FLOOR MAT AND METHOD FOR ASSEMBLING SUCH A MAT

(71) Applicant: Michel Grosjean, Saint Martin d'Hères (FR)

(72) Inventor: Michel Grosjean, Saint Martin d'Hères (FR)

( * ) Notice: Subject to any disclaimer, the term of this patent is extended or adjusted under 35 U.S.C. 154(b) by 69 days.

(21) Appl. No.: 14/879,747

(22) Filed: Oct. 9, 2015

(65) Prior Publication Data

US 2017/0099974 A1 Apr. 13, 2017

(51) Int. Cl.
*A47L 23/26* (2006.01)
*A47G 27/02* (2006.01)

(52) U.S. Cl.
CPC ..... *A47G 27/0206* (2013.01); *A47G 27/025* (2013.01)

(58) Field of Classification Search
CPC ..... Y10T 428/18; A47L 23/26; A47L 23/266
USPC ..... 428/54
See application file for complete search history.

(56) References Cited

U.S. PATENT DOCUMENTS 4,590,110 A 5/1986 Arens

FOREIGN PATENT DOCUMENTS

DE 20115339 U1 1/2002
DE 202004001764 U1 6/2005
EP 0125618 A1 11/1984

*Primary Examiner* — Alexander Thomas
(74) *Attorney, Agent, or Firm* — Oliff PLC

(57) ABSTRACT

A floor mat comprising several sections each provided with a trench designed to receive an insert, each section having first and second lateral grooves extending along respectively two longitudinal axes, and several joining elements, each joining element being configured to join two sections to one another, each joining element comprising a first set of main tabs inserted in the second lateral groove of a first section and a second set of main tabs inserted in the first lateral groove of a second section.

17 Claims, 7 Drawing Sheets

FLOOR MAT AND METHOD FOR ASSEMBLING SUCH A MAT

BACKGROUND OF THE INVENTION

The invention relates to floor mats, and in particular to entrance mats designed to be used in public places where people frequently walk on the mat.

STATE OF THE ART

At the present time, entrance mats of public places prevent dirt and damp conveyed by the soles of footwear from getting inside buildings. These mats are indispensable elements for maintenance of the premises, safety of persons, and to keep the surrounding floor coating in good condition. Furthermore, such mats have to be sufficiently rugged to stand up to having a large number of people walking on them. In FIGS. 1 and 2, a floor mat 1 has been illustrated according to two embodiments of the prior art. In general manner, floor mats 1 are fitted in a cavity 5*a* inside a floor coating 5. Mats 1 comprise several sections 2 each provided with a trench 3 designed to receive an insert 4. Sections 2 are rigid bars of the same length and are placed on a floor 5, either directly on the floor 5 or on a protective coating 6. Inserts 4 are made from materials designed to clean and dry the soles of shoes, for example of carpet type, made from rubber or synthetic mini-brushes. Sections 2 are joined to one another by joining elements 7.

In FIG. 1, a mat 1 according to a first embodiment according to the prior art has been represented wherein joining elements 7 are steel cables which pass through sections 2 via drilled holes provided on the lateral faces 8*a*, 8*b* of sections 2. Several dozens of sections 2 can in this way be joined to one another. Mat 1 further comprises intercalated rubber parts 9 situated between two neighbouring sections 2, thereby creating free spaces between sections 2 to receive the dust released by the soles of shoes. Mat 1 further comprises a screw 10 to block cables 7 and to secure a certain number of sections 2 to one another. But insertion of cables 7 through the different holes and blocking of the cables by means of the screw 10 are delicate operations. Manufacturing of such mats 1 is generally performed in the plant, and they are then installed on their place of use. But these mats 1 are heavy and are generally transported rolled up, which limits their size. Another drawback is that sufficient space must be provided underneath inserts 4 to be able to run the cables 7, which means that inserts 4 are raised. These mats are therefore not suitable for floors which do not comprise a cavity. Nor can they be installed in the thickness of the most frequently used coatings.

In FIG. 2, another floor mat 1 according to a second embodiment of the prior art has been represented wherein joining elements 7 are fasteners made from rubber or plastic. This mat 1 can be fitted inside a cavity or placed on top of floor 5. Fasteners 7 can have the same length as that of sections 2 and may have holes drilled in them. Grooves 11*a*, 11*b* are provided on the lateral faces 8*a*, 8*b* of sections 2 to make fasteners 7 slide. But in this case, a large clearance space is required around mat 1 to make the sections slide in fasteners 7 when assembly of the elements forming mat 1 is performed. Fasteners 7 can be simple lugs so as to leave spaces between sections 2 for dust which will be subsequently removed when maintenance operations are performed. Grooves 11*a*, 11*b* are C-shaped with the opening facing the neighbouring section 2 so that the top faces of inserts 4 are at the same level. But such a system is also difficult to install on site. In particular, sections 2 have to be raised so as to be able to make fasteners 7 slide in grooves 11*a*, 11*b*.

European patent application EP0125618 and German patent applications DE202004001764 and DE20115339 can also be cited which disclose a floor mat comprising several sections joined to one another by an elastic joining element provided with a pair of arms at each end. The arms of each pair have hook-like spikes and are separated from one another so as to be able to move towards one another, by elastic deformation, when they are inserted in the grooves of the sections. But these joining elements are complex to achieve and it is further necessary to ensure that the grooves width of the sections is adjusted to the distance between the arms of each pair to insert the joining elements in the grooves.

OBJECT OF THE INVENTION

The object of the invention consists in remedying these drawbacks, and more particularly in providing a floor mat, in particular an entrance mat, that is easy to assemble either in a dedicated manufacturing workshop or on a location where it is to be used which may be confined.

Another object of the invention is to provide a mat that is sufficiently rugged while at the same time being as light as possible so as to be easily transported.

Another object of the invention is to provide a mat whose thickness can vary so as to be able to be placed on a floor provided with a cavity or not, or in the thickness of the coating, tiling or flooring for example, without it being necessary to make alterations to the doors.

According to one feature of the invention, a floor mat is proposed comprising several sections each provided with a trench designed to receive an insert, each section having first and second lateral grooves extending along respectively two longitudinal axes, and several joining elements, each joining element being configured to join two sections to one another.

In this mat, each joining element comprises at least two main tabs designed to cooperate with respectively the first and second lateral grooves of two different sections, and each main tab is configured to be inserted in at least one lateral groove of at least one section in a direction perpendicular to the longitudinal axis of the lateral groove in which said main tab is inserted.

In particular, each joining element comprises:

- a first set of main tabs spaced apart from one another along a longitudinal axis of the joining element and designed to cooperate with at least one lateral groove of a first section, and
- a second set of second main tabs spaced apart from one another along the longitudinal axis of the joining element and designed to cooperate with at least one lateral groove of a second section.

A mat is thus provided having joining elements that are simple to manufacture so as to facilitate insertion of the latter in the lateral grooves of the sections.

In particular, the first set of main tabs is inserted in the second lateral groove of a first section, and the second set of main tabs is inserted in the first lateral groove of a second section.

Preferably, first and second sets comprise aligned main tabs, and the sets are also noted rows.

Each main tab of the first and second set may be inserted in a direction perpendicular to the longitudinal axis of the lateral groove in which said main tab is inserted.

At least one joining element may comprise only the first and second sets of main tabs joined to one another by an intermediate part.

The joining elements are thus even easier to produce, as they comprise only a single set of tabs on each edge.

At least one main tab comprises an end provided with a plurality of teeth in order to prevent any longitudinal sliding of the sections.

The longitudinal axes of the lateral grooves of each section can be parallel to one another.

Each lateral groove of each section can be provided with at least a notch extending along the longitudinal axis of the lateral groove to prevent each main tab inserted in the lateral groove from being extracted in the direction perpendicular to the longitudinal axis of the lateral groove.

According to one embodiment, each section comprises two lateral faces, and the two lateral grooves of the section are respectively situated against the two lateral faces of the section.

According to another embodiment, each section comprises a bottom face forming a bottom of the trench and the first and second lateral grooves of the section are respectively situated against two lateral edges of the bottom face.

Each section can comprise an additional groove extending along a longitudinal axis of the section, situated against the bottom face and configured to receive the main tabs of a same row.

Each lateral groove can form a concavity oriented in a direction perpendicular to the floor when the sections are placed on the floor.

The mat can further comprise several bases on which the sections are respectively placed, each base being provided with two complementary grooves configured to be respectively situated facing the first and second lateral grooves of the section placed on the base, each joining element further comprising at least two additional tabs designed to cooperate with respectively two complementary grooves of two different bases so as to join the two different bases to one another.

Each complementary groove can also extend along a secondary axis, and each additional tab is configured to be inserted in at least one complementary groove of at least one base in a direction perpendicular to the secondary axis of the complementary groove in which said additional tab is inserted.

The first and second sets of main tabs can be oriented in a same main direction, and the additional tabs are oriented in parallel manner to the main tabs of the first and second sets and in an opposite direction to the main direction.

Each main or additional tab can comprise an end having the form of a hook.

According to another feature of the invention, an assembling method of a floor mat is proposed, comprising:

providing several sections each provided with a trench and with first and second lateral grooves extending respectively along two longitudinal axes; and mounting an insert in each trench.

The method further comprises:

providing several joining elements each comprising:

a first set of main tabs spaced apart from one another along a longitudinal axis of the joining element and designed to cooperate with at least one lateral groove of a first section, and a second set of main tabs spaced apart from one another along the longitudinal axis of the joining element and designed to cooperate with at least one lateral groove of a second section; and for each joining element, inserting the first set of main tabs in the second lateral groove of a first section, and inserting the second set of main tabs in the first lateral groove of a second section so as to join the first and the second sections to one another.

The method can further comprise, before inserting the first set of main tabs, separating the sections by means of a separating tool configured to create a space between each section, each space being designed to receive at least one joining element.

BRIEF DESCRIPTION OF THE DRAWINGS

Other advantages and features will become more clearly apparent from the following description of particular embodiments and implementation modes of the invention given for non-restrictive example purposes only and represented in the appended drawings, in which.

DETAILED DESCRIPTION

Figure 1:
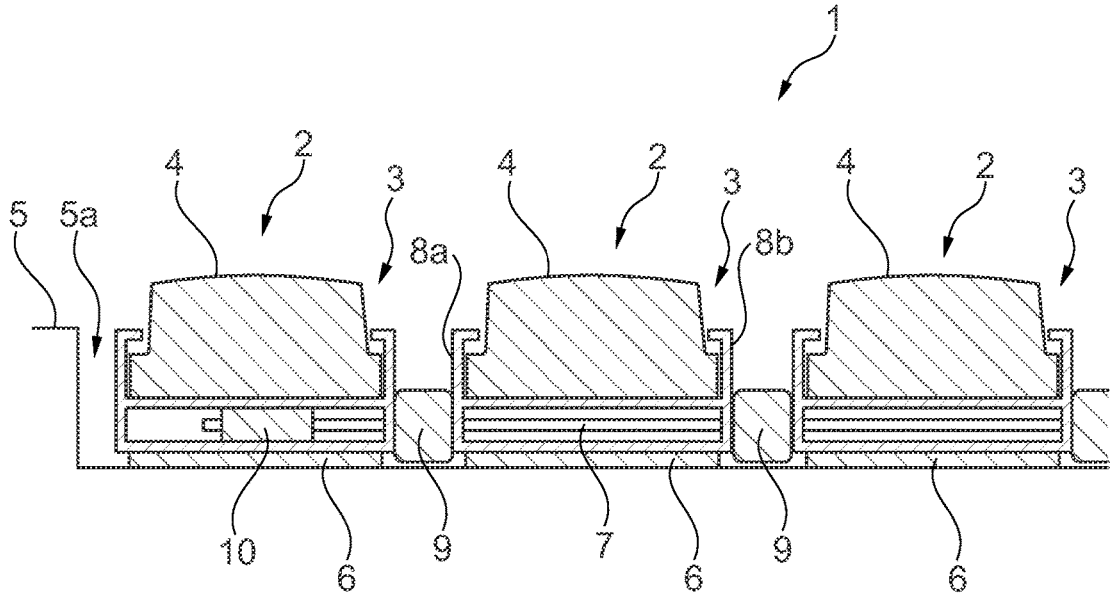
Fig. 1 (Prior art)
FIGS. 1 and 2 schematically illustrate two floor mats according to the prior art.
Figure 2:
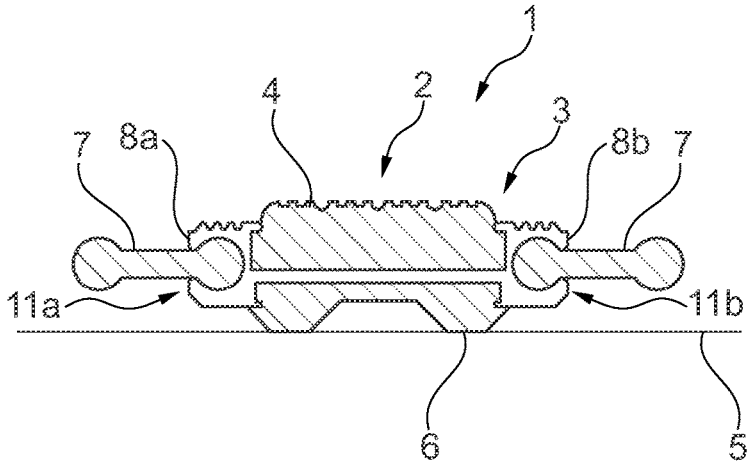
Fig. 2 (Prior art)
Figure 3:
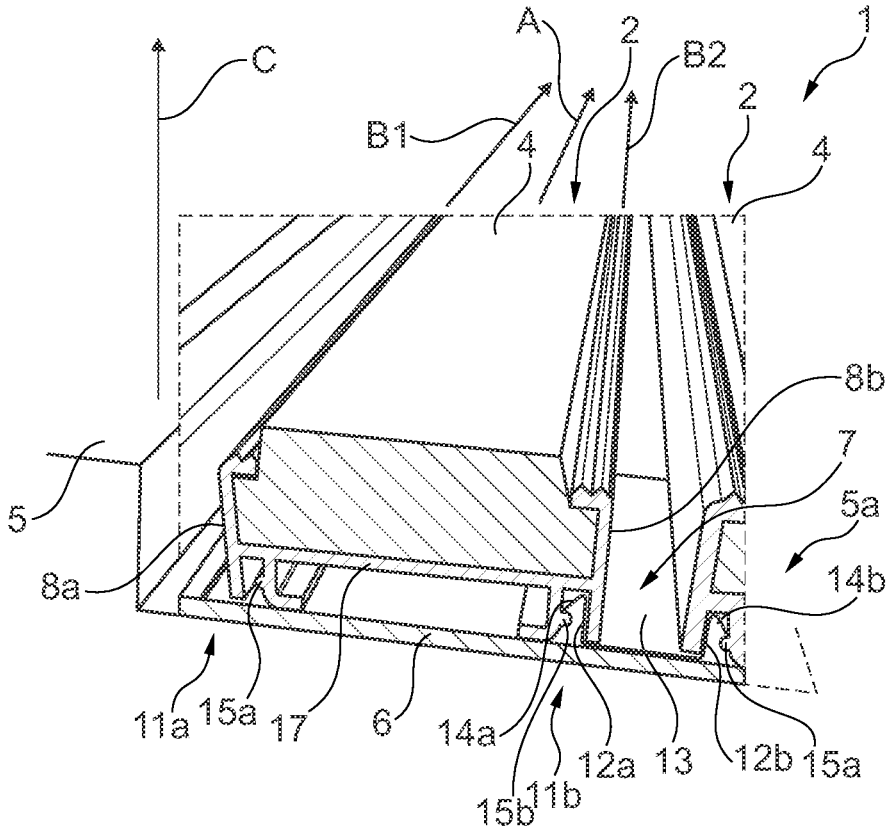
FIG. 3 schematically illustrates a perspective view of an embodiment of a floor mat according to the invention.
Figure 4:
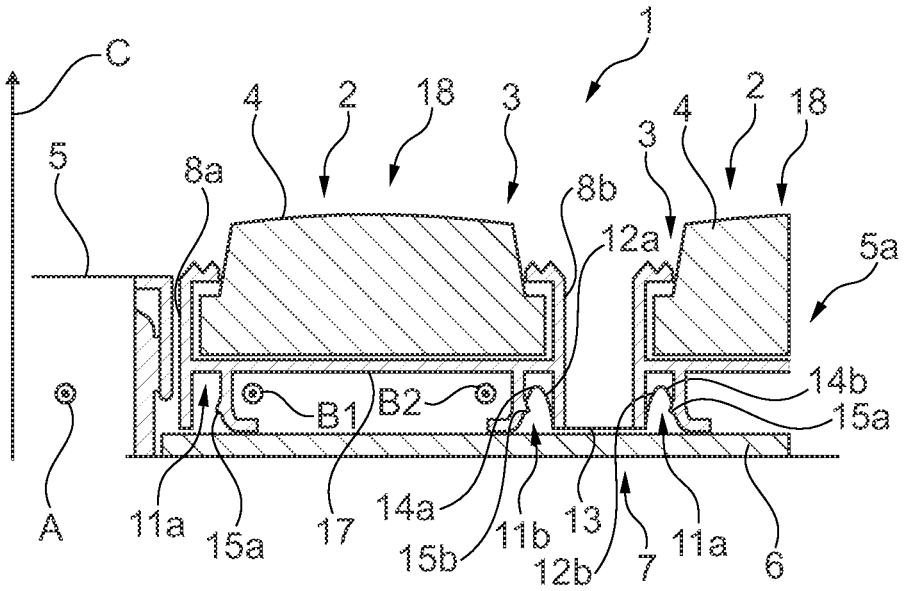
FIG. 4 schematically illustrates a front view of the floor mat described in FIG. 3.
Figure 5:
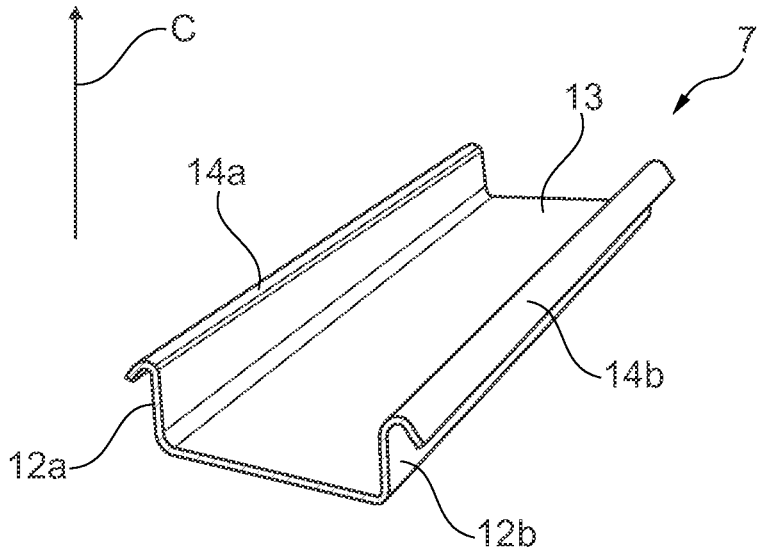
FIG. 5 schematically illustrates a perspective view of an embodiment of a joining element.

In FIGS. 3 and 4, an embodiment of a floor mat 1 according to the invention has been represented. Floor mat 1 comprises several sections 2, in particular rigid sections 2. Each section 2 is designed to be placed on the floor 5, either directly or on a coating 6. For example, sections 2 can be placed on the bottom of a cavity 5*a* provided in floor 5. Coating 6 is preferably made from rubber to prevent sections 2 from smacking on floor 5. Coating 6 can also be made from an acoustically insulating synthetic material. Each section 2 is in the form of a bar which extends along a main axis A. When sections 2 are placed on floor 5, main axes A of sections 2 are preferably parallel to one another. For example, sections 2 can be made from aluminium to be light and resistant to torsion, or they can be made from plastic. Each section 2 comprises a trench 3 designed to receive an insert 4, in particular a flexible insert 4. Inserts 4 can be configured to allow friction of soles of shoes, in other words inserts 4 can be of sole-scraper type. For example inserts 4 are of carpet or brush type. Each section 2 comprises two lateral faces 8*a*, 8*b*, a bottom face 17 forming the bottom of trench 3, and an opening 18 situated opposite bottom face 17 to allow a part of insert 4 be salient. Each section 2 further comprises two lateral grooves 11*a*, 11 *b* which extend along respectively two longitudinal axes B1, B2. Lateral grooves 11*a*, 11*b* have for example a rectangular cross-section, in particular a U-shaped cross-section. In general manner, longitudinal axes B1, B2 of a same section 2 are in a same plane. Longitudinal axes B1, B2 can be inclined with respect to one another. Preferentially, the two longitudinal axes B1, B2 of a same section 2 are parallel to one another and to the main axis A of section 2. In order to keep sections 2 joined to one another, mat 1 further comprises several joining elements 7. In particular, each joining element 7 is designed to join two sections 2 to one another. Joining elements 7 are preferably made from stainless steel to provide a maximum strength while at the same time being sufficiently thin to achieve a minimum space occupation. They can also be made from plastic with a larger thickness to preserve a sufficient mechanical strength between sections 2. In FIG. 5, a perspective view of an embodiment of a joining element 7 has been represented. Each joining element 7 comprises an intermediate part 13 joining two main tabs 12*a*, 12*b*. The two main tabs 12*a*, 12*b* are respectively located at the ends of joining element 7. The two main tabs 12*a*, 12*b* can be parallel to one another and the intermediate part 13 can be flat. When the longitudinal axes B1, B2 of a same section 2 are inclined with respect to one another, main tabs 12*a*, 12*b* are also inclined with respect to one another so as to be able to be inserted in the two lateral grooves 11*b*, 11*a* of two different sections. For example, each joining element 7 is U-shaped. The two main tabs 12*a*, 12*b* are configured to cooperate with respectively two lateral grooves 11*b*, 11*a* of two different sections 2. In particular, each main tab 12*a*, 12*b* is configured to be inserted in at least one lateral groove 11*a*, 11*b* of at least one section 2. For example, each main tab 12*a*, 12*b* comprises an end 14*a*, 14*b*, opposite the intermediate part 13, having the shape of a hook.

In FIGS. 3 and 4, a joining element 7 inserted in two lateral grooves 11*a*, 11*b* of two different sections 2 has been represented. In general manner, each main tab 12*a*, 12*b* is configured to be inserted in at least one lateral groove 11*a*, 11*b* in a direction C perpendicular to the longitudinal axis B1, B2 of lateral groove 11*a*, 11 *b* in which said main tab is inserted. More particularly, each main tab 12*a*, 12*b* is inserted in a lateral groove 11*a*, 11*b* in a direction C perpendicular to the bottom face 17 of section 2 in which said main tab is inserted. It is therefore no longer necessary to have a clearance face around mat 1 to join sections 2 to one another as fixing of joining elements 7 is performed in an area delineated by mat 1. Furthermore, each lateral groove 11*a*, 11*b* forms a concavity oriented in a direction perpendicular to bottom face 17 of section 2, in particular in an opposite direction to the direction C. Dust is therefore prevented from depositing in the bottom of lateral grooves 11*a*, 11 *b* when lateral grooves 11*a*, 11 *b* are directed towards floor 5, which facilitates cleaning operations of mat 1.

In FIGS. 3 and 4, the longitudinal axes B1, B2 of grooves 11*a*, 11 *b* are parallel to one another, in FIG. 4 they are perpendicular to the plane of the sheet. Furthermore, each lateral groove 11*a*, 11*b* of each section 2 is provided with an least one notch 15*a*, 15*b* extending along longitudinal axis B1, B2 of lateral groove 11*a*, 11 *b*. Notches 15*a*, 15*b* prevent main tabs 12*a*, 12*b* from coming out of lateral grooves 11*a*, 11 *b* in an opposite direction to the direction C in which they are inserted. Advantageously, joining elements 7 can be removed from lateral grooves 11*a*, 11 *b* by making them slide along the axes B1, B2 of lateral grooves 11*a*, 11*b* to disassemble mat 1.

Figures 6, 7, 8, 9, 10:
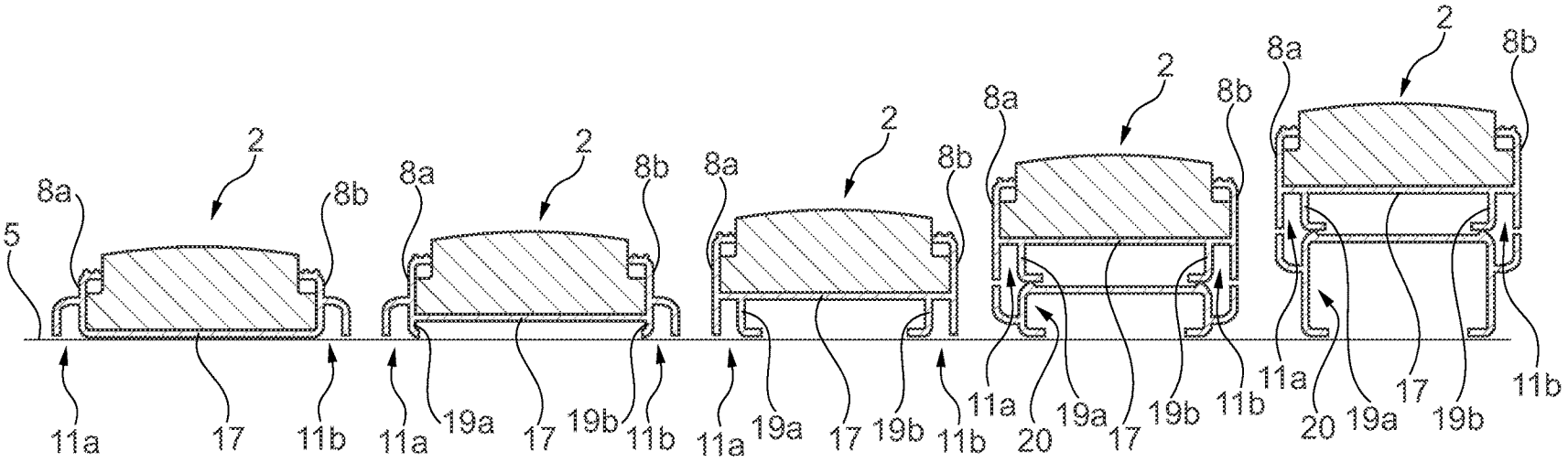
FIGS. 6 to 8 schematically illustrate front views of other embodiments of a section.
FIGS. 9 to 11 schematically illustrate front views of another embodiment of a floor mat.

According to a first embodiment illustrated in FIGS. 3, 4 and 8, the two lateral grooves 11*a*, 11*b* of a same section 2 are respectively situated against the two lateral edges of bottom face 17.

In FIGS. 6 and 7, other embodiments of sections 2 have been represented. In these other embodiments, the two lateral grooves 11*a*, 11*b* of a same section 2 are respectively situated against the two lateral faces 8*a*, 8*b* of section 2. In FIG. 6, bottom face 17 of section 2 is placed on floor 5, either directly or by means of a coating 6. In FIGS. 7 to 10, section 2 comprises feet 19*a*, 19*b* situated against bottom face 17 to raise section 2 with respect to floor 5. The thickness of the mat can thus be easily adjusted according to the type of floor 5, with or without a cavity.

Figure 11:
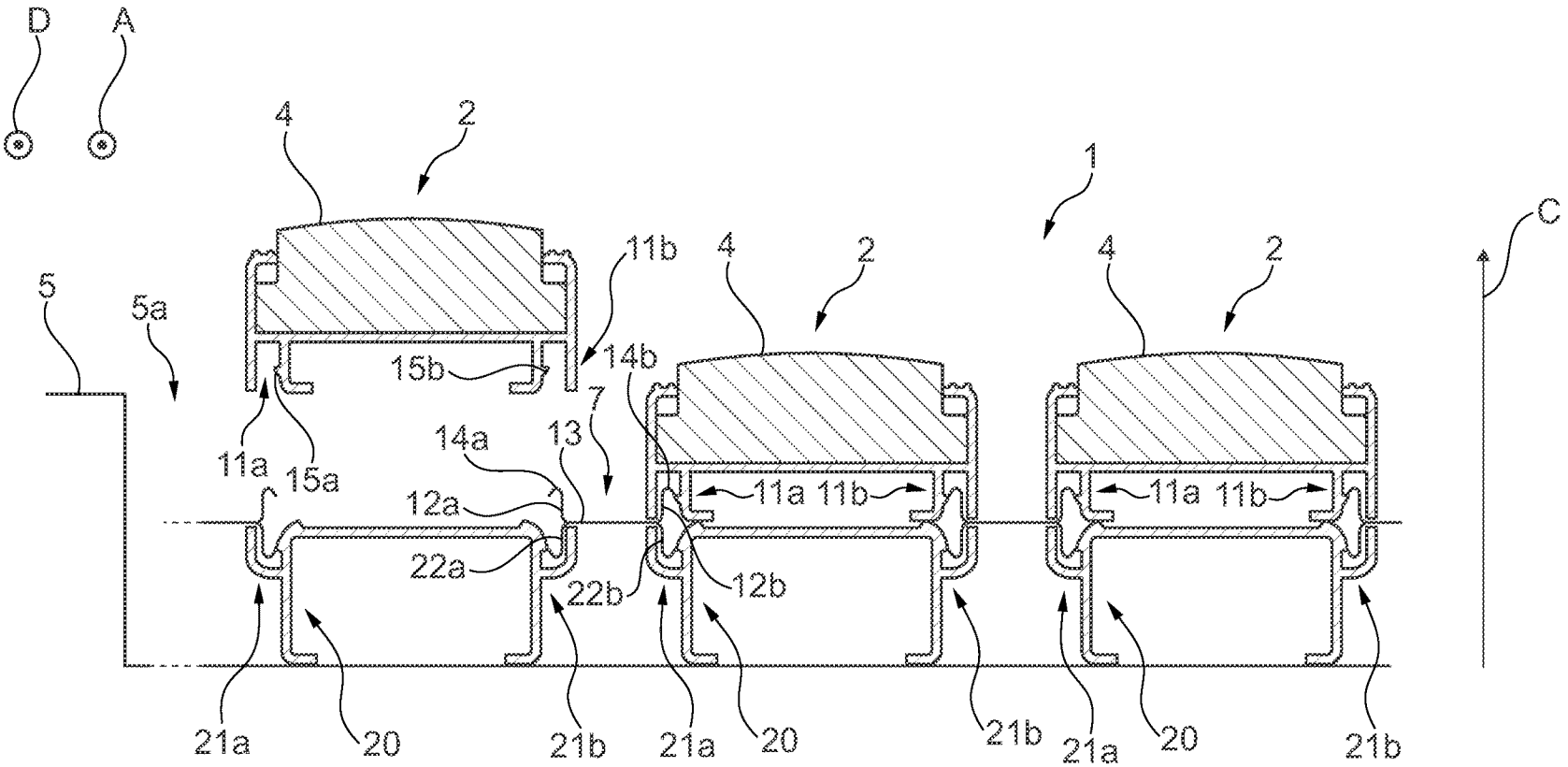

In FIGS. 9 to 12, another embodiment of a floor mat 1 according to the invention has been represented. In this other embodiment, sections 2 can be of the type described in the previous figures. Furthermore, mat 1 comprises several bases 20 on which sections 2 are respectively placed. Bases 20 enable sections 2 to be raised. As illustrated in FIGS. 9 and 10, the height of bases 20 can vary according to the mats used. The height of bases 20 of a same mat is adjusted to the depth of cavity 5*a* so that inserts 4 are all situated at the level of the coating of floor 5. Preferably, bases 20 have a length equal to that of sections 2. In FIG. 11, three bases 20 and three sections 2 have been represented for example purposes. Each joining element 7 is further configured to mechanically join a section 2 with base 20 on which section 2 is placed. Furthermore, each joining element 7 is configured to join two different bases 20 to one another. A mat 1 is thus provided having a structure which is particularly solid and stable. Each base 20 is provided with two complementary grooves 21*a*, 21*b* configured to be respectively situated facing the two lateral grooves 11*a*, 11 *b* of section 2 placed on base 20. Furthermore, each complementary groove 21*a*, 21*b* forms a concavity oriented in the direction C, i.e. in an opposite direction to those of the concavities formed by lateral grooves 11*a*, 11*b*. Each joining element 7, as illustrated in FIG. 11, further comprises two additional tabs 22*a*, 22*b* designed to cooperate with respectively two complementary grooves 21*b*, 21*a* of two different bases 20. In particular, each complementary groove 21*a*, 21*b* extends along a secondary axis D. Preferably, the secondary axes D are parallel to one another and to the main axes A of sections 2 when sections 2 are placed on their associated bases 20. Each additional tab 22*a*, 22*b* is configured to be inserted in at least one complementary groove 21*a*, 21*b* of at least one base 20 in a direction perpendicular to the secondary axis of complementary groove 21*a*, 21*b* in which said additional tab is inserted. In the example illustrated in FIG. 11, the additional tabs 22*a*, 22*b* are inserted in the complementary grooves 21*b*, 21*a* in an opposite direction to the direction C when bases 20 are placed on floor 5.

Figure 12:
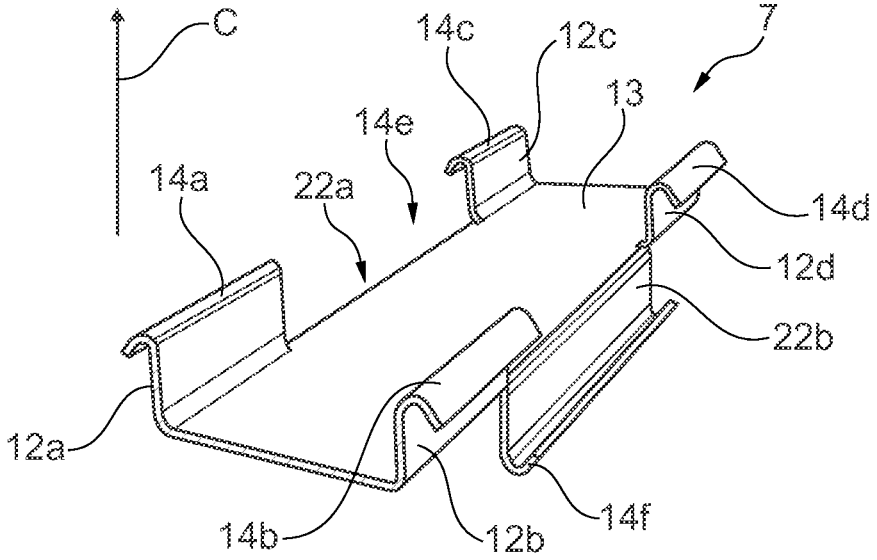
FIG. 12 schematically illustrates a perspective view of another embodiment of a joining element.

Another embodiment of a joining element 7 has been represented in FIG. 12. In this other embodiment, joining element 7 comprises two pairs of main tabs 12*a* to 12*d* oriented in a same main direction, which is the direction C when joining elements 7 are inserted in sections 2 placed on bases 20. The additional tabs 22*a*, 22*b* are oriented in parallel manner to one another and in an opposite direction to that of the main tabs 12*a* to 12*d* of joining element 7. Furthermore, each main tab 12*a* to 12*d* comprises an end 14*a* to 14*d* in the form of a hook so as to keep joining elements 7 inserted in sections 2. Furthermore, each additional tab 22*a*, 22*b* can comprise an end 14*e*, 14*f* in the form of a hook so as to keep joining elements 7 inserted in bases 20.

Figure 15:
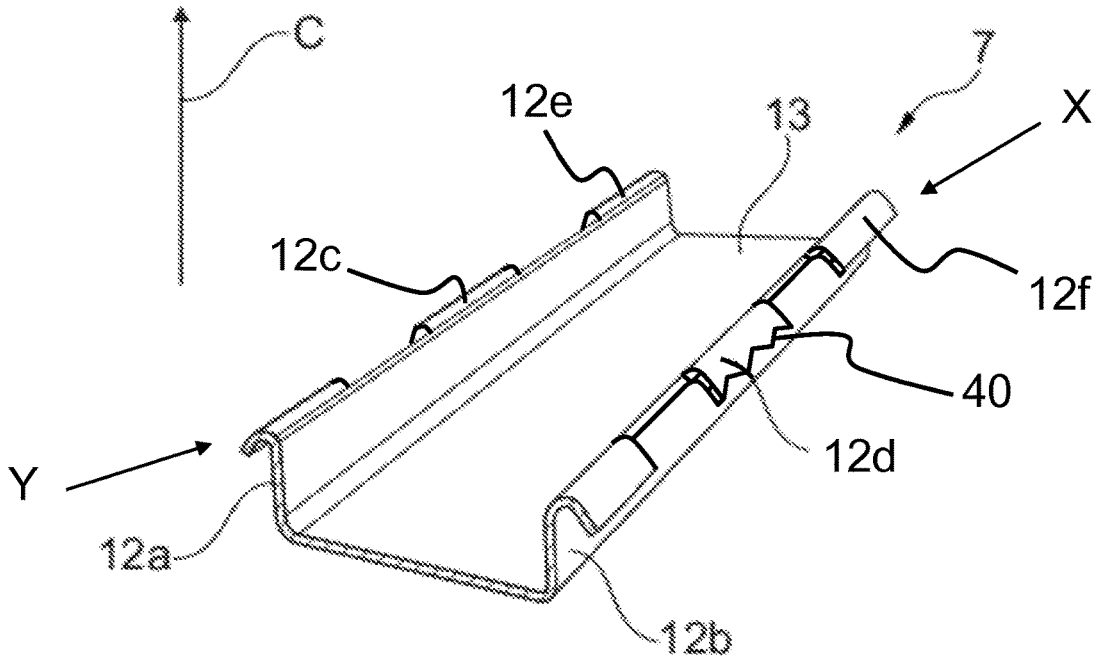
FIG. 15 schematically illustrates a perspective view of another embodiment of a joining element.

Another embodiment of a joining element 7 has been represented in FIG. 15. In this other embodiment, joining element 7 comprises a first row Y of first main tabs 12*a*, 12*c*, 12*e* and a second row X of second main tabs 12*b*, 12*d* and 12*f*. First and second main tabs 12*a* to 12*f* are joined to one another by intermediate part 13 described in FIG. 5. In general manner, intermediate part 13 has the shape of a quadrilateral, preferably a rectangle. In particular, the first main tabs 12*a*, 12*c*, 12*e* are situated on a first edge of intermediate part 13, in other words on a first end of joining element 7. The second main tabs 12*b*, 12*d*, 12*f* are for their part situated on a second edge of intermediate element 13 opposite the first edge, in other words on a second end of joining element 7. The first main tabs 12*a*, 12*c*, 12*e* are aligned and extend along the first edge of intermediate part 13. The second main tabs 12*a*, 12*c*, 12*e* are aligned and extend along the second edge of intermediate part 13. When the first and second edges of intermediate part 13 are parallel to one another, the first and second main tabs 12*a* to 12*f* then extend along a longitudinal axis of joining element 7. Furthermore, the first main tabs 12*a*, 12*c*, 12*e* are spaced apart from one another along the first edge of joining element 7, and the second main tabs 12*b*, 12*d*, 12*f* are spaced apart from one another along the second edge in order, in particular, to facilitate insertion of the tabs in the lateral grooves of the sections. Furthermore, spacing the main tabs enables the weight of joining element 7 to be reduced. For example, the first main tabs are respectively positioned facing the second main tabs. When joining element 7 is inserted in the sections, the first main tabs are inserted in a lateral groove 11*b* of a first section, and the second main tabs are inserted in a lateral groove 11*a* of a second section. In this case, the first main tabs 12*a*, 12*c*, 12*e* are arranged along the longitudinal axis B2 of lateral groove 11*b* of the first section, and the second main tabs 12*b*, 12*d*, 12*f* are arranged along the longitudinal axis B1 of lateral groove 11*a* of the second section. In particular, the longitudinal axis of joining element 7 extends in the direction of the main axis A of the sections. In this other embodiment, the first and second main tabs 12*a* to 12*f* are oriented in a same main direction, which is direction C when joining elements 7 are inserted in sections 2.

Joining element 7 can also comprise at least two additional tabs designed to cooperate respectively with two complementary grooves of two different bases 20. As described previously in FIG. 12, additional tabs 22*a*, 22*b* are oriented in parallel manner to one another and in an opposite direction to that of main tabs 12*a* to 12*f* of joining element 7. Furthermore, each main tab 12*a* to 12*f* can comprise an end in the form of a hook so as to keep joining elements 7 inserted in sections 2. The hook of each main and additional tab is elastic and can retract onto itself when it is inserted in a groove. Furthermore, in the retracted position, it exerts a pressure against the inner walls of the groove in order to keep element 7 joined to the section. The hooks therefore enable the tabs to adjust to the width of the grooves of the sections.

For example, at least one joining element 7 comprises only the first and second rows Y, X of main tabs joined to one another by the intermediate part. As a variant, each joining element only comprises two rows of main tabs. Thus, unlike the state of the art which comprises pairs of arms, the width of the lateral grooves of the sections can be reduced.

At least one main tab 12*d* comprises an end provided with a plurality of teeth 40 in order to prevent any longitudinal sliding of the sections.

Figure 16:
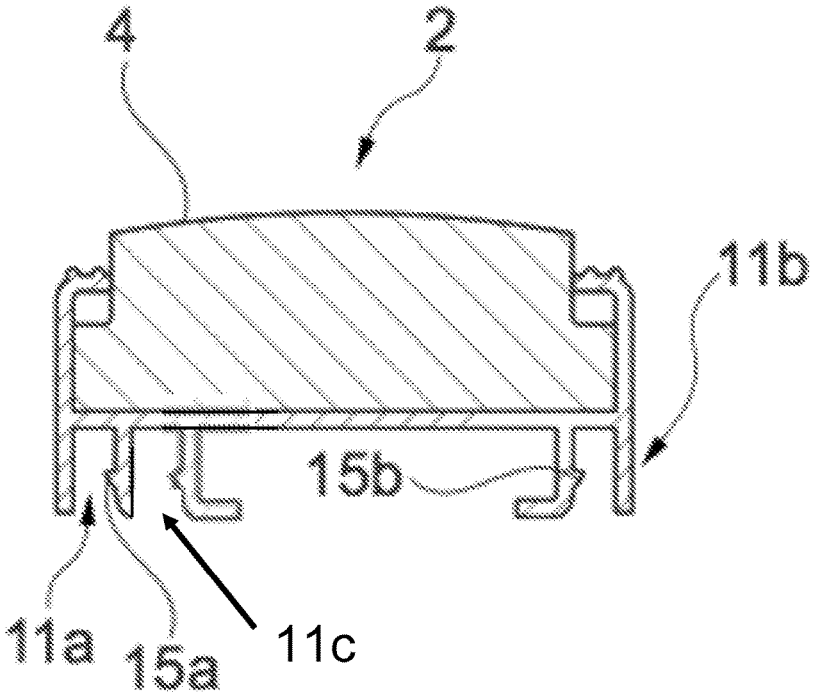
FIG. 16 schematically illustrates a front view of another embodiment of a section for a floor mat according to the invention.

In FIG. 16, another embodiment of a floor mat 1 has been represented. In this other embodiment, each section 2 comprises an additional groove 11*c* extending along a longitudinal axis, preferably a longitudinal axis parallel to the longitudinal axis B1 of lateral groove 11*a* of the section. For example, additional groove 11*c* is adjacent to lateral groove 11*a*. Furthermore, additional groove 11*c* is situated against bottom face 17 of section 2, and is configured to receive the main tabs 12*b*, 12*d*, 12*f* of a same row X. Additional groove 11*c* enables varying the spacing between two sections while using the same joining element 7. Indeed, the main tabs 12*b*, 12*d*, 12*f* of row X can be inserted either in lateral groove 11*a* for a larger spacing or in additional groove 11*c* for a smaller spacing. Furthermore, each additional groove 11*c* can be provided with at least one notch extending along the longitudinal axis of additional groove 11*c*. The notches prevent the main tabs from coming out of the additional grooves 11*c* in an opposite direction to the direction C in which said main tabs were inserted.

Figure 14:
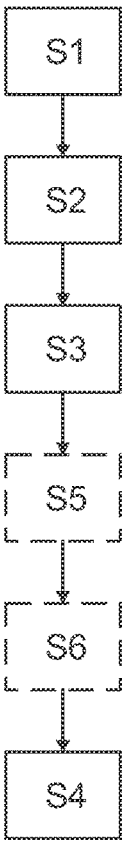
FIG. 14 schematically illustrates the main steps of an implementation mode of a manufacturing method of a floor mat according to the invention.

In FIG. 14, an implementation mode of a manufacturing method of a floor mat according to the invention has been represented. The method comprises a step S1 in which sections 2 each provided with a trench 3 and with two lateral grooves 11*a*, 11*b* extending along respectively two longitudinal axes of B1, B2 are made. The method comprises a step S2 in which each insert 4 is mounted in its respective trench 3. The method also comprise a manufacturing step S3 of several joining elements 7 each comprising at least two main tabs 12*a*, 12*b*. This step S3 can be performed before one of the previous steps. The method further comprises an inserting step S4 of joining elements in the sections. In the inserting step, at least two main tabs 12*a*, 12*b* are inserted in respectively two lateral grooves of two different sections 2. In particular, when inserting the joining elements 7, each main tab 12*a* to 12*d* is inserted in a lateral groove 11*a*, 11*b* in a direction perpendicular to the longitudinal axis B1, B2 of lateral groove 11*a*, 11*b* in which said main tab is inserted. As a variant, before the inserting step S4 wherein joining elements in the sections, the method comprises a manufacturing step S5 of several bases 20, followed by an inserting step S6 wherein at least two additional tabs 22*a*, 22*b* of each joining element 7 are respectively inserted in two complementary grooves 21*b*, 21*a* of two different bases 20.

Figure 13:
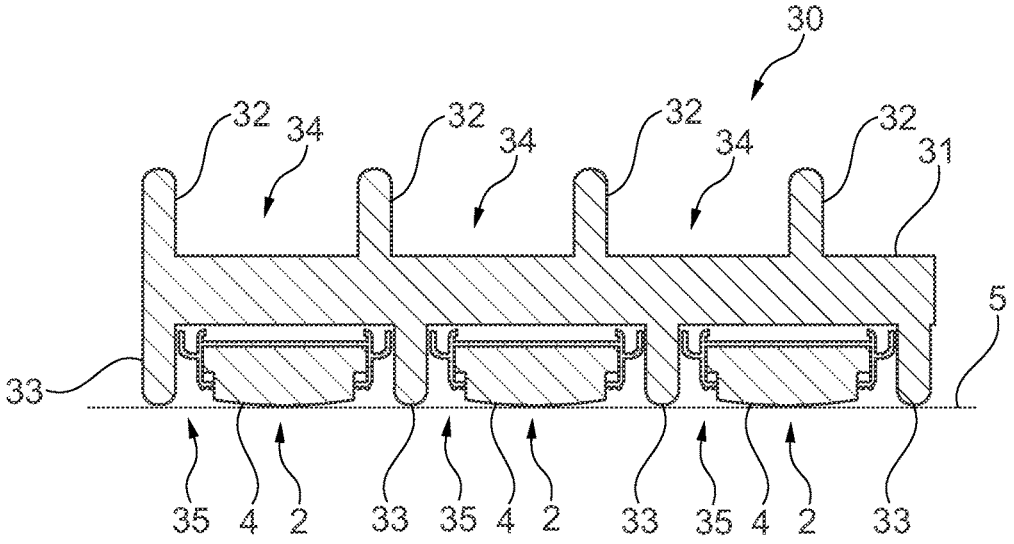
FIG. 13 schematically illustrates a front view of a separating tool configured to create spaces designed to receive the joining elements.

In FIG. 13, a separating tool 30 used to facilitate inserting the joining elements 7 in sections 2 and in bases 20 has been represented. Separating tool 30 enables sections 2 to be separated in order to create a space between each section 2 so as to be able to easily insert joining elements 7 in lateral grooves 11*a*, 11*b*. In other words, separating tool 30 enables the sections 2 to be positioned parallel to one another. Separating tool 30 also enables bases 20 to be separated in order to create a space between each base 20 so as to be able to easily insert joining elements 7 in the complementary grooves 22*a*, 22*b*. In other words, separating tool 30 enables bases 20 to be positioned parallel to one another. Preferably, separating tool 30 is configured to maintain a same distance, or a same space, between each section 2 and between each base 20. Depending on requirements, separating tool 30 can be configured to maintain different spaces between sections 2 and between bases 20, while at the same time keeping them parallel to one another. Each space is designed to receive a joining element 7. Separating tool 30 comprises a body 31 of rectangular parallelepiped shape, and first and second teeth 32, 33 salient from body 31. First teeth 32 are situated on a first longitudinal face of body 31 and second teeth 33 are situated on a second longitudinal face opposite the first face. Preferably, first and second teeth 32, 33 are perpendicular to body 31. In general manner, first and second teeth 32, 33 are arranged in regular manner on their respective faces so as to delineate first and second housings 34, 35. Housings 34, 35 are configured to receive sections 2 or bases 20. The spaces to receive joining elements 7 correspond to the thicknesses of first and second teeth 32, 33. In particular, each housing 34, 35 of tool 30 is configured to receive a section 2 or a base 20. More particularly, all the first housings 34 have a same length and all the second housings 35 have a same length equal to or different from that of the first housings 34. Separating tool 30 has a variable length according to the number of sections 2, or of bases 20, which it is desired to place in regular manner on floor 5. In particular, the width of tool 30 is smaller than the length of sections 2, or of bases 20, so as to enable inserting the joining elements 7 while leaving the tool in contact with sections 2, or with bases 20, to maintain the spaces between them. An implementation mode of manufacturing of a mat 1 without base 20, described in FIGS. 3 and 4, has been illustrated in FIG. 13. In this implementation mode, inserts 4 are preferably placed facing floor 5, and sections 2 are then separated by means of separating tool 30. Joining elements 7 are then inserted in sections 2. Then separating tool 30 is removed. Sections 2 joined to one another by joining elements 7 are then turned and sections 2 are placed on floor 5 in order to form mat 1.

In another implementation mode of manufacturing of mat 1 with bases 20 described in FIGS. 8 and 9, bases 20 are preferably placed on floor 5, and bases 20 are then separated by means of separating tool 30 defined in the foregoing. Then joining elements 7 are inserted in complementary grooves 22*a*, 22*b* of bases 20. The main tabs of joining elements 7 are then inserted in sections 2 in order to form mat 1.

The invention claimed is:

1. A floor mat comprising:

several sections each provided with a trench designed to receive an insert, each section having first and second lateral grooves extending along respectively two longitudinal axes; and several joining elements, each joining element being configured to join two sections to one another;

each joining element comprising:

a first set of main tabs spaced apart from one another along a longitudinal axis of the joining element; and a second set of main tabs spaced apart from one another along the longitudinal axis of the joining element;

the first set of main tabs being configured to be inserted in the second lateral groove of a first section and the second set of main tabs being configured to be inserted in the first lateral groove of a second section.

2. The mat according to claim 1, wherein each main tab of the first and second sets being inserted in a direction perpendicular to the longitudinal axis of the lateral groove in which said main tab is inserted.

3. The mat according to claim 1, wherein at least one joining element comprises only the first and second sets of main tabs joined to one another by an intermediate part.

4. The mat according to claim 1, wherein at least one main tab comprises an end provided with a plurality of teeth.

5. The mat according to claim 1, wherein the longitudinal axes of the first and second lateral grooves of each section are parallel to one another.

6. The mat according to claim 1, wherein each lateral groove is provided with at least a notch extending along the longitudinal axis of said lateral groove to prevent the main tabs inserted in said lateral groove from being extracted in the direction perpendicular to the longitudinal axis of said lateral lateral groove.

7. The mat according to claim 1, wherein each section comprises two lateral faces, and the first and second lateral grooves of said section are respectively situated against the two lateral faces of said section.

8. The mat according to claim 1, wherein each section comprises a bottom face forming a bottom of the trench and the first and second lateral grooves of said section are situated respectively against two lateral edges of the bottom face.

9. The mat according to claim 8, wherein each section comprises an additional groove extending along a longitudinal axis of said section, situated against the bottom face and configured to receive the main tabs of a first or second set.

10. The mat according to claim 9, wherein the first and second sets of main tabs are oriented in a same main direction, and the additional tabs are oriented in parallel manner to the main tabs of the first and second sets and in an opposite direction to the main direction.

11. The mat according to claim 9, wherein each main or additional tab comprises an end having the form of a hook.

12. The mat according to claim 1, wherein each lateral groove forms a concavity oriented in a direction perpendicular to the floor when the sections are placed on the floor.

13. The mat according to claim 1, comprising several bases on which the sections are respectively placed, each base being provided with two complementary grooves configured to be respectively situated facing the first and second lateral grooves of the section placed on the base, each joining element further comprising at least two additional tabs designed to cooperate with respectively two complementary grooves of two different bases so as to join the two different bases to one another.

14. The mat according to claim 13, wherein each complementary groove extends along a secondary axis, and the said at least two additional tabs are configured to be inserted in the two complementary grooves of one base in a direction perpendicular to the secondary axis of said complementary groove.

15. An assembling method of a floor mat, comprising:

providing several sections each provided with a trench and with first and second lateral grooves extending respectively along two longitudinal axes;

mounting an insert in each trench; and providing several joining elements, each joining element comprising:

a first set of main tabs spaced apart from one another along a longitudinal axis of the joining element, and a second set of main tabs spaced apart from one another along the longitudinal axis of the joining;

for each joining element, inserting the first set of main tabs in the second lateral groove of a first section, and inserting the second set of main tabs in the first lateral groove of a second section so as to join the first and the second sections to one another.

16. The method according to claim 15, comprising inserting each main tab of the first and second set in a direction perpendicular to the longitudinal axis of the lateral groove in which said main tab is inserted.

17. The method according to claim 15, comprising, before inserting the first set of main tabs, separating the sections by means of a separating tool configured to create a space between each section, each space being designed to receive one joining element.

* * * * *